US005090210A

United States Patent [19]

Katayanagi et al.

[11] Patent Number: 5,090,210

[45] Date of Patent: Feb. 25, 1992

[54] CONTROL SYSTEM FOR ICE MAKING APPARATUSES

[75] Inventors: Hideyuki Katayanagi; Hideaki Furutachi, both of Gunma, Japan

[73] Assignee: Sanyo Electric Co., Ltd., Osaka, Japan

[21] Appl. No.: 667,607

[22] Filed: Mar. 8, 1991

[30] Foreign Application Priority Data

Mar. 12, 1990 [JP] Japan ..... 2-58091
Mar. 12, 1990 [JP] Japan ..... 2-58092

[51] Int. Cl.[5] ..... F25C 1/00
[52] U.S. Cl. ..... 62/135; 62/233
[58] Field of Search ..... 62/135, 234, 283; 236/46 R; 165/12

[56] References Cited

U.S. PATENT DOCUMENTS 3,850,005 11/1974 Sayles ..... 62/135
3,977,851 8/1976 Toya ..... 62/135
4,665,710 5/1987 Kyzer et al. ..... 62/234

*Primary Examiner*—William E. Wayner

*Attorney, Agent, or Firm*—Darby & Darby

[57] ABSTRACT

An ice making apparatus includes a refrigeration means having ice making chambers and repeats ice making cycles that involve refrigeration processes to freeze water supplied in the ice making chambers and ice releasing processes to release the ice. These processes are controlled by means of sensors which measure thermal conditions of the apparatus such as condensation temperature and condensation pressure of a refrigerant, and the temperature of the refrigeration means. The control system stores and updates the times required for refrigeration process and ice releasing process under normal sensor conditions and, based on these data, permits the apparatus to make ice even under sensor malfunction that occurred during an ice making cycle. The control system of the invention also permits the apparatus to start ice making cycles under sensor malfunction that has occurred prior to the start up of the apparatus by storing a set of standard reference time data needed to the start up, thereby allowing the apparatus to provide ice irrespective of sensor conditions.

3 Claims, 7 Drawing Sheets

REFRIGERATION LAMP
ABNORMALITY INDICATOR
GM
CM
FM
PM
HV
WV
CPU
MEMORY
MEMORY 1
MEMORY 2
MEMORY 3
PROGRAM
DATA TABLE
COUNTER
TIMER 1
TIMER 2
TIMER 3
INTERFACE
ICE LEVEL SENSOR
START UP SW.
ICE RELEASE SW.
WATER FEED SW.
WATER TRAY OPEN / CLOSE DETECTOR SW.
WATER LEVEL SW.
A/D
REFRIGERATION SENSOR
CONDENSER TEMP / PRESSURE SENSOR
CLOCK CIRCUIT
OSC
91
92
10
93
94
9a
95
12
37
35
36
83
38
34
90
84
85
86
20
14
87
32
33
88
89

CONTROL SYSTEM FOR ICE MAKING APPARATUSES

FIELD OF THE INVENTION

The invention relates to a control system for controlling ice making operations of an apparatus having a plurality of refrigeration chambers to form ice by freezing water introduced in the refrigeration chambers.

BACKGROUND OF THE INVENTION

Ice making apparatuses of the type mentioned above generally repeat ice making cycles consisting of two types of processes, i.e. an ice making process in which water fed to ice making members is frozen, and an ice releasing process in which the ice making members are warmed by a hot gas and the like after ice is formed on the ice making members so that the ice may be released therefrom. The performance of such ice making process is greatly influenced by ambient conditions, in particular ambient temperature. For example, the thickness of the ice formed in a given period of time is thinner in summer than in winter. The applicant of this invention, therefore, disclosed an ice making apparatus that may automatically controls periods of ice making processes in accordance with ambient temperature so that ice of substantially constant thickness may be manufactured (Japanese Patent Publication No. 59-36175).

Such ice making apparatus as disclosed in the above mentioned publication, however, has a disadvantage that ice may not be made at all or may be made only unsatisfactory if sensors used in the ice making apparatus fails to function normally.

BRIEF SUMMARY OF THE INVENTION

A primary object of the invention is therefore to overcome such a disadvantage as mentioned above, through use of a microcomputer. The invention provides a control system that allows an ice making apparatus to continue ice making processes even under malfunction of temperature sensors.

In order to attain this object, the control system of the invention uses a microcomputer that stores and updates the periods of ice making process as well as ice releasing process when a normal ice making operation is carried out, and, in an event that the sensors have lost their proper function, utilizes the last stored data to continue ice making operation.

Another object of the invention is to provide a control system for an ice making apparatus, the control system being capable of providing a standard data for starting ice making operation normally even if the temperature sensors are in malfunction from the start.

In one aspect, a control system for use with an ice making apparatus by a refrigeration system having a multiplicity of ice making chambers and a refrigeration means for freezing water introduced in the ice making chambers, said refrigeration system repeating an ice making cycle which consists of a refrigeration process for freezing the water and of an ice releasing process for releasing the ice formed in the chambers, comprises: a condensation sensor for detecting the thermal conditions of a refrigerant through a condenser in the refrigeration system; a sensor for detecting the temperature of said refrigeration means; a microcomputer having means for adjusting the time of said refrigeration process based on the output of said condensation sensor and means for terminating said ice releasing process based on the output of said refrigeration sensor, counters for counting the time required for said refrigeration process (which will be referred to as refrigeration time) and the time required for the ice releasing process (which will be referred to as ice releasing time) for each ice making cycle, memories for storing and updating time data corresponding to the counted times, sensors for detecting abnormality of said condensation sensor and refrigeration sensor, and a control means for enabling said ice making cycles based on the time data obtained in the preceding ice making cycle and stored in said memories even when said sensors are in malfunction.

Since the refrigeration time data and the ice releasing data are updated in the memories after each ice making cycle, the ice making apparatus may continue a subsequent ice making operation based on these data if the sensors has lost their normal functions during the operation.

In another aspect, a control system for use with an ice making apparatus by a refrigeration system having a multiplicity of ice making chambers and a refrigeration means for freezing water introduced in the ice making chambers, said refrigeration system repeating an ice making cycle which consists of a refrigeration process for freezing the water and of an ice releasing process for releasing the ice formed in the chambers, comprises: a condensation sensor for detecting the thermal conditions of a refrigerant through a condenser in the refrigeration system; a sensor for detecting the temperature of said refrigeration means; a microcomputer having means for adjusting the time of said refrigeration process based on the output of said condensation sensor and means for terminating said ice releasing process based on the output of said refrigeration sensor, counters for counting the time required for said refrigeration process and the time required for the ice releasing process for each ice making cycle, memories for storing and updating time data corresponding to the counted times, initialization means for inputting in said memories at the start up of said ice making apparatus a set of standard empirical reference time data required for the refrigeration process and ice releasing process in obtaining normal ice, sensors for detecting abnormality of said condensation sensor and refrigeration sensor, and a control means for enabling said ice making apparatus to start and continue said ice making cycles based on the standard reference time data stored in the memories even when said sensors are in malfunction at the start up of said apparatus.

With this control system, even when the sensors are malfunctioning from the beginning, the ice making apparatus may start its ice making operation to manufacture normal ice based on such standard empirical refrigeration time data and the ice releasing data input in the memory at the time of start up.

DETAILED DESCRIPTION OF THE PREFERRED EMBODIMENT

Figure 1:
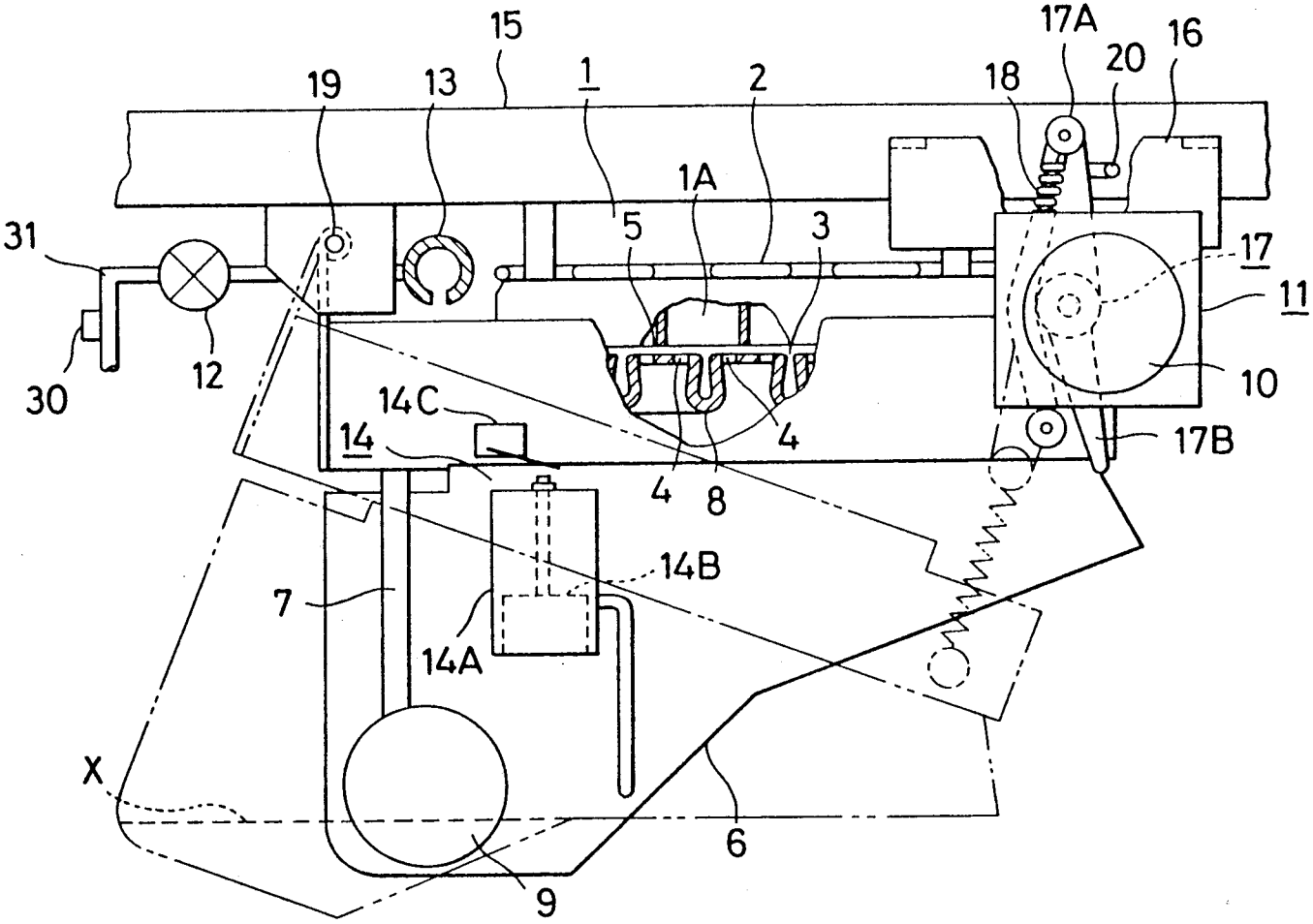
FIG. 1 is a side elevation of an type ice making apparatus, partially cut away for illustration, utilizing a control system of the invention.

Referring to FIG. 1, an ice making apparatus is now described. The apparatus includes: a plurality of ice making chambers 1A having downward openings; a refrigeration means 1 having, on the outer surface thereof, an evaporation pipe 2 of a refrigeration system; a water tray 5 for closing each of the ice making chamber 1A from below and having in the surface thereof water injection holes one for each ice making chamber 1A and water return holes 4; a water tank 6 secured to the water tray 5 and communicating with the water return holes 4; a water pump 9 for feeding water to each ice making chamber 1A through a water tank 6, a water supply pipe 7, a distributor 8, and the water injection hole 3; a driving means for pivotally displacing the water tray 5 by a low-speed motor 10; a water sprayer 13 for spraying water on the surface of the water tray 5 when a water supply valve 12 is opened; and a water level detector 14 for detecting the level of the water in the tank 6 by a water level switch 14C and a float 14B in a float tank 14A which communicates with the water tank 6. The low-speed motor 10 is mounted on a plate 16 secured to supporting beam 15. The shaft of the motor is connected with a driving cam 17. The shaft is provided with a pair of oppositely extending first and second arms 17A and 17B, respectively. A coil spring 18 which is connected at one end thereof to the end of the first arm 17A is connected at the other end to the side of the water tray 5. The tray is pivotally mounted on a shaft 19. The low-speed motor 10 has a speed reduction mechanism and its forward rotation results in rotation of the driving cam 17 in the counter clockwise direction. A see-saw type switch 20 assumes a first position as it is driven by a counter clockwise rotation of a second arm 17B of the driving cam 17, where the switch cuts off the electric power to the motor 10 so that the water tray 5 is held at an inclined position. The switch 20 assumes a second position as it is driven by a clockwise rotation of the first arm 17A, where the switch cuts off the electric power to the motor 10 so that the water tray 5 is held at level closing position. A water temperature sensor 30, which is a thermostat, is provided in a water supply pipe 31 for detecting the temperature of the water to be injected. The dotted line X in the figure show the level of the water in the tank at the inclined position. The ice making apparatus also includes a refrigeration unit (not shown) which includes such components as a compressor (COMP), a fan motor (FM), a condenser, and hot gas valves (HG valves) for feeding or stopping a hot gas (HG) to warm the walls of the ice making chambers in releasing the ice.

The ice making cycle of the above mentioned apparatus consists of two major processes, i.e. a refrigeration process and an ice releasing process. The refrigeration process is preceded by a water feeding process and, at the very beginning of the ice making, preliminary refrigeration of the chambers 1A to about 0° C.

Referring to FIG. 1, these processes are discussed below. The ice releasing process is completed when the water tray 5 closes the ice making chambers 1A. The water supply valve 12 is opened to supply water in the tank 6. A circulation pump 9 is turned on during a process of water supply. A water level detector 14 detects the level of the water in the tank. The water supply valve 12 is closed to stop feeding as the water level detector 14 detects a predetermined level (full water level) of the water in the water tank 6. Then an ice releasing process is started. In this process water is circulated from the water tank through water injection hole 3, ice making chambers 1A, water return passages 4, and back to the tank 6. Since the compressor (COMP) is in operation, the refrigeration means 1 is performing refrigeration during this process. At beginning of each refrigeration process, preliminary refrigeration is given, as pointed out above. This is to cool the refrigeration means 1 to about 0° C. prior to making ice, since the refrigeration means 1 is initially not cold enough (not below 0° C.) to freeze the water injected into the ice making chambers 1A. The refrigeration means 1 is provided on the outer surface thereof with a temperature sensor 32 (which will be referred to as refrigeration sensor, see FIG. 4). When the refrigeration sensor 32 detects 0° C., the preliminary refrigeration is ended. Normally this preliminary refrigeration lasts about 10 minutes. The water passed into each ice making chamber 1A is gradually frozen therein. It should be noted that time needed for forming a given amount of ice in the chambers 1A greatly depends on the thermal properties e.g. condensation temperature and condensation pressure, of the refrigerant used. Therefore, it is necessary to determine the length of the refrigeration time for a particular refrigerant chosen.

To do so a sensor 33 (which will be referred to as condensation sensor) is provided to the refrigeration system. The condensation sensor 33 is mounted on the surface of the outlet pipe of the refrigerant of the condenser, which measures the condensation temperature or condensation pressure of the refrigerant. The need for adjustment of refrigeration time is disclosed in the previously mentioned Japanese Patent Publication 58-36175. In the present invention, a data table 83 (FIG. 4) stores refrigeration time data needed for the operation of the condenser in making a given amount of ice in accordance with the condensation temperature as detected by the condenser sensor 33. For example, when the condenser sensor 33 detects a temperature, the CPU 36 retrieves corresponding time data for the period of condensation, and compares this time data with time counted by timer 2 in the counter 38. The CPU 36 stops the operation of the condenser when these two times coincide. In this manner the period for ice making operation may be adjusted to make a constant amount of ice in the ice making chambers 1A based on the condensation temperature detected by the sensor 33. This process is followed by an ice releasing process.

In the ice releasing process, the circulation pump 9 is stopped, and the driving motor 10 is driven in the forward direction, i.e. in the direction so as to fully incline the water tray 5 to open the bottom of the ice making chambers. At the same time the hot gas valve (HG valve) is opened to provide a hot gas through the evaporation pipe 2 in order to heat the ice chambers 1A so that the ice formed therein is dropped off the chambers 1A. At the same time the water supply valve 12 is also opened to spray water from the water sprayer 13 on the water tray 5 to remove the ice remaining thereon. The water tray 5 remains there until the refrigeration sensor 32 senses the temperature of the refrigeration means 1 to be at a predetermined temperature, e.g. 9° C., when the driving motor 10 is driven again, backward, in order to bring the water tray 5 back to the initial position to close the ice making chambers 1A. As the chambers 1A are closed, the ice releasing process is ended. This process usually takes 3–4 minutes.

In this manner the ice making apparatus may continue controlled refrigeration and ice releasing processes based on the measurement of the condensation temperature/pressure of the refrigerant by the sensor 33 and the measurement of the temperature of the refrigeration means by the sensor 32.

Features of the invention are as follows. The invention adds further control to the above mentioned control of the refrigeration processes.

Figure 2A:
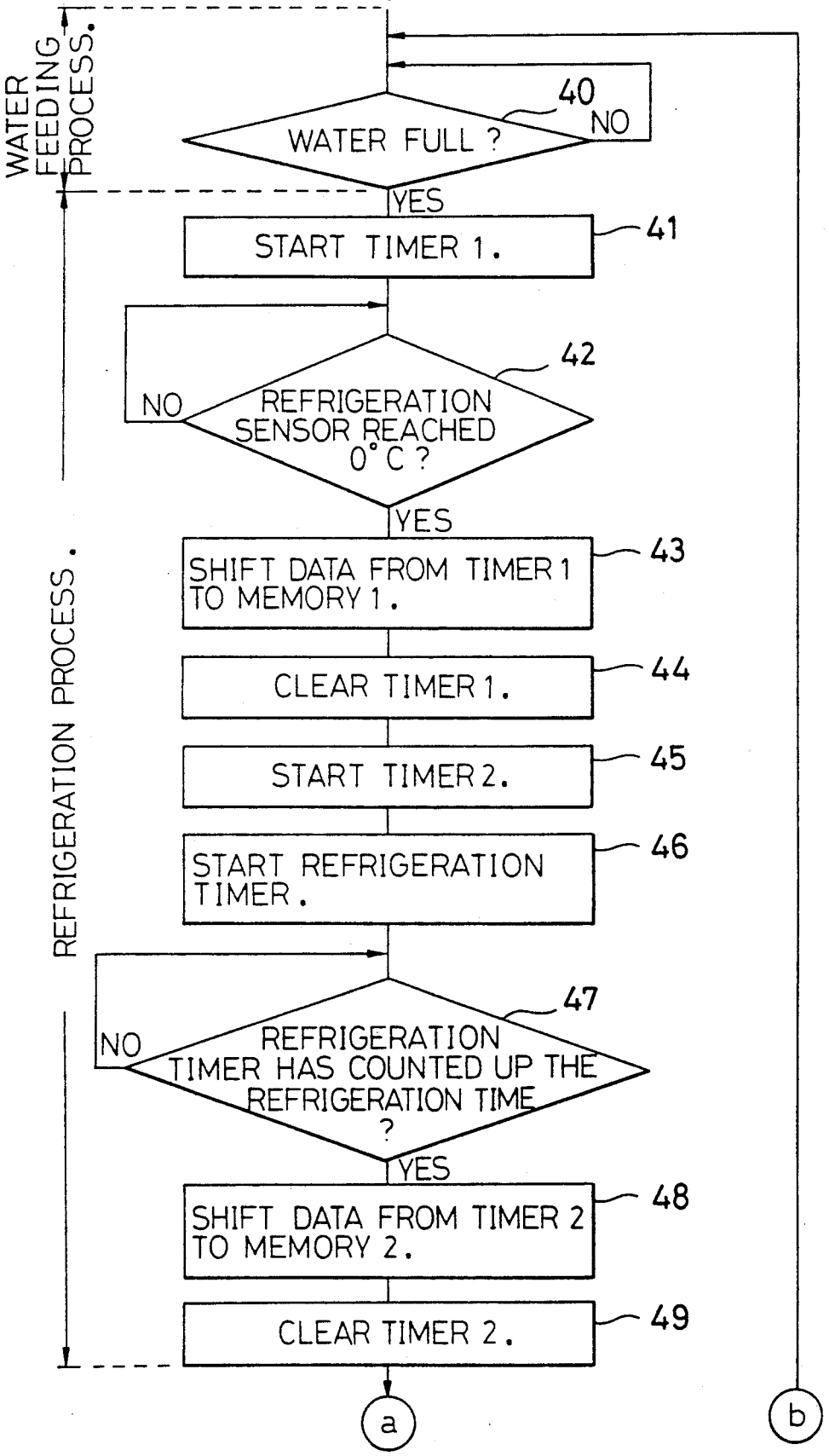
FIG. 2 is a flow chart of an ice making operation of the apparatus with normal sensors.
Figure 2B:
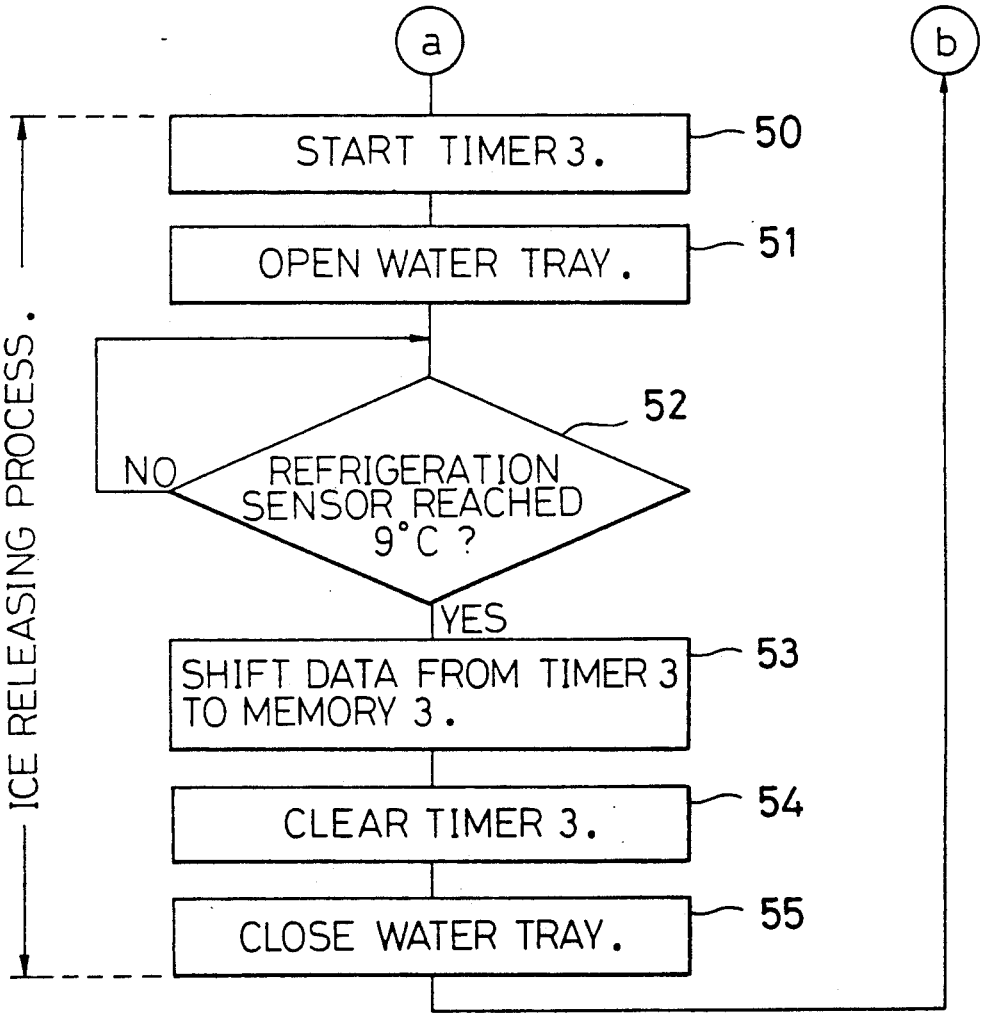

Firstly, when the ice making apparatus is operating normally, the ice making cycles follows steps shown in FIG. 2. As the water tray 5 is filled with water (YES in STEP 40), the water supply process is ended and a refrigeration process is started. A timer 1 is then started (STEP 41). The timer 1 counts the period of time from the start up of the refrigeration process till the detection of 0° C. by the refrigeration sensor 32. This time data is stored in a memory 1 (STEP 43) and the timer 1 is cleared (STEP 44). These STEPS 41 through 43 correspond to the preliminary refrigeration for gradually lowering the temperature of the refrigeration means 1° to 0° C. Thus the timer 1 counts the period of the preliminary refrigeration, which is stored in the memory 1 as preliminary refrigeration time data.

Next, a timer 2 and a refrigeration timer are started (STEPS 45 AND 56). The timer 2 is provided to count up the refrigeration time determined by the CPU 36 on the basis of the output of the condenser sensor 33 which is fed to the CPU 36 through an interface 34. As the refrigeration time is counted up (YES in STEP 47), the time is stored in a memory 2 (STEP 48), and the timer 2 is cleared (STEP 49) to finish the refrigeration process. The timer 2 thus counts the period of time between the start up of the refrigeration timer and the end of the counting up. The memory 2 stores this time as refrigeration time data.

Following the refrigeration process (ending at STEP 49), an ice releasing process is started at STEP 50 where a timer 3 is started and the water tray 5 is opened (STEP 51). Hot gas is furnished to the evaporation pipe to warm the walls of the ice making chambers 1A and release the ice blocks formed therein until the refrigeration sensor 32 detects 9° C. The ice blocks will drop before the detection of 9° C. When the temperature of 9° C. is detected (YES in STEP 52), the time counted by the timer 3 is stored in a memory 3 (STEP 53) and the timer 3 is cleared (STEP 54). The water tray 5 is closed (STEP 55) and water supply process is resumed. The timer 3 thus measures the time used for the ice releasing process i.e. the time interval from the time of opening to the closing of the tray 5 subsequent to the detection of 9° C. by the refrigeration sensor 32. The memory 3 stores this time as the ice releasing time data.

If the next ice making cycle is executed, the preliminary refrigeration time data, refrigeration time data, and ice releasing time data in the memories 1, 2, and 3 are updated by the timers 1, 2, 3, respectively.

In this manner these time data concerning preliminary refrigeration, refrigeration, and ice releasing processes are updated by the timers 1, 2, and 3 in response to changes in ambient temperature during repeated ice making cycles.

Figure 3A:
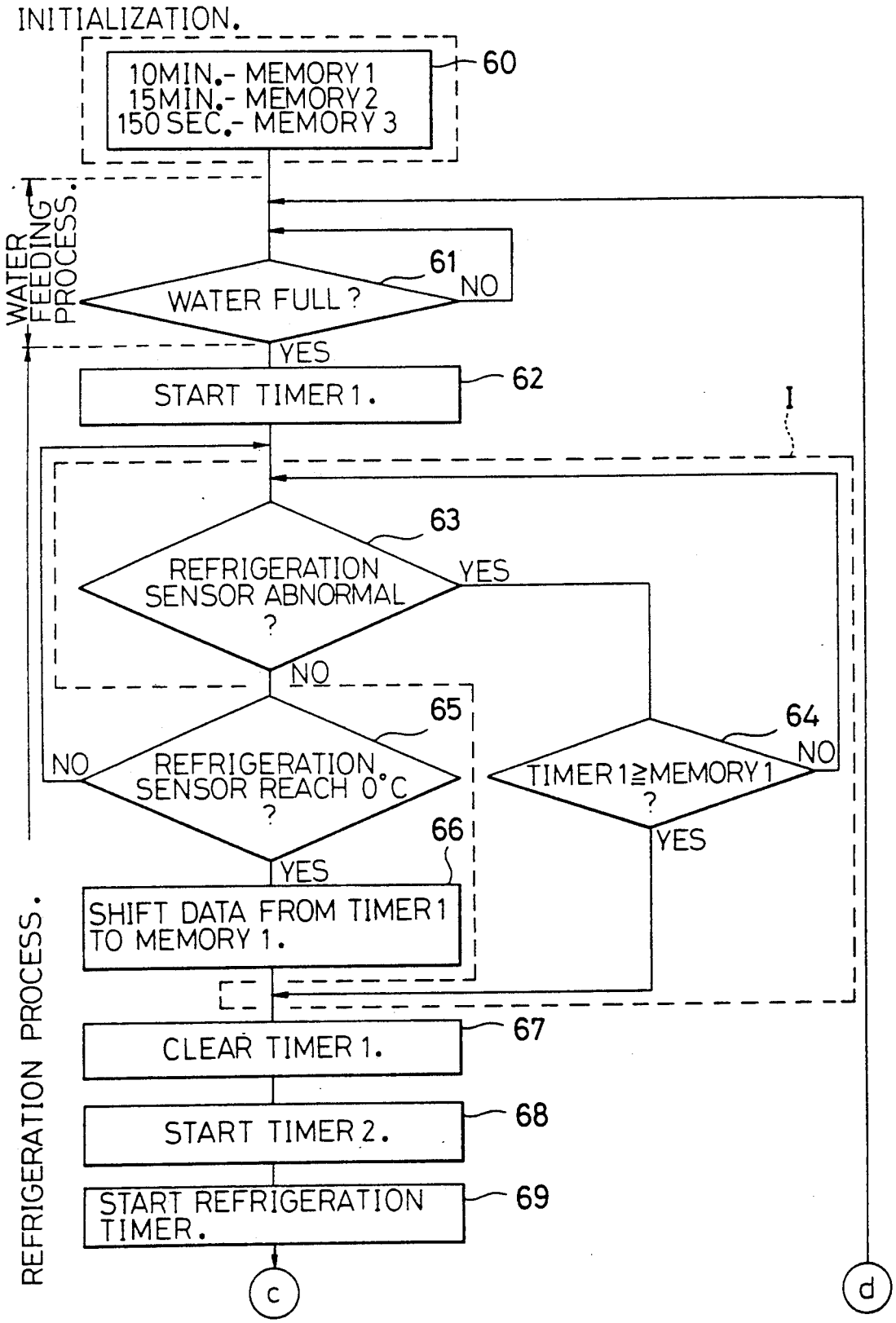
FIG. 3 is a flow chart of an ice making operation of the apparatus with abnormal sensors.
Figure 3B:
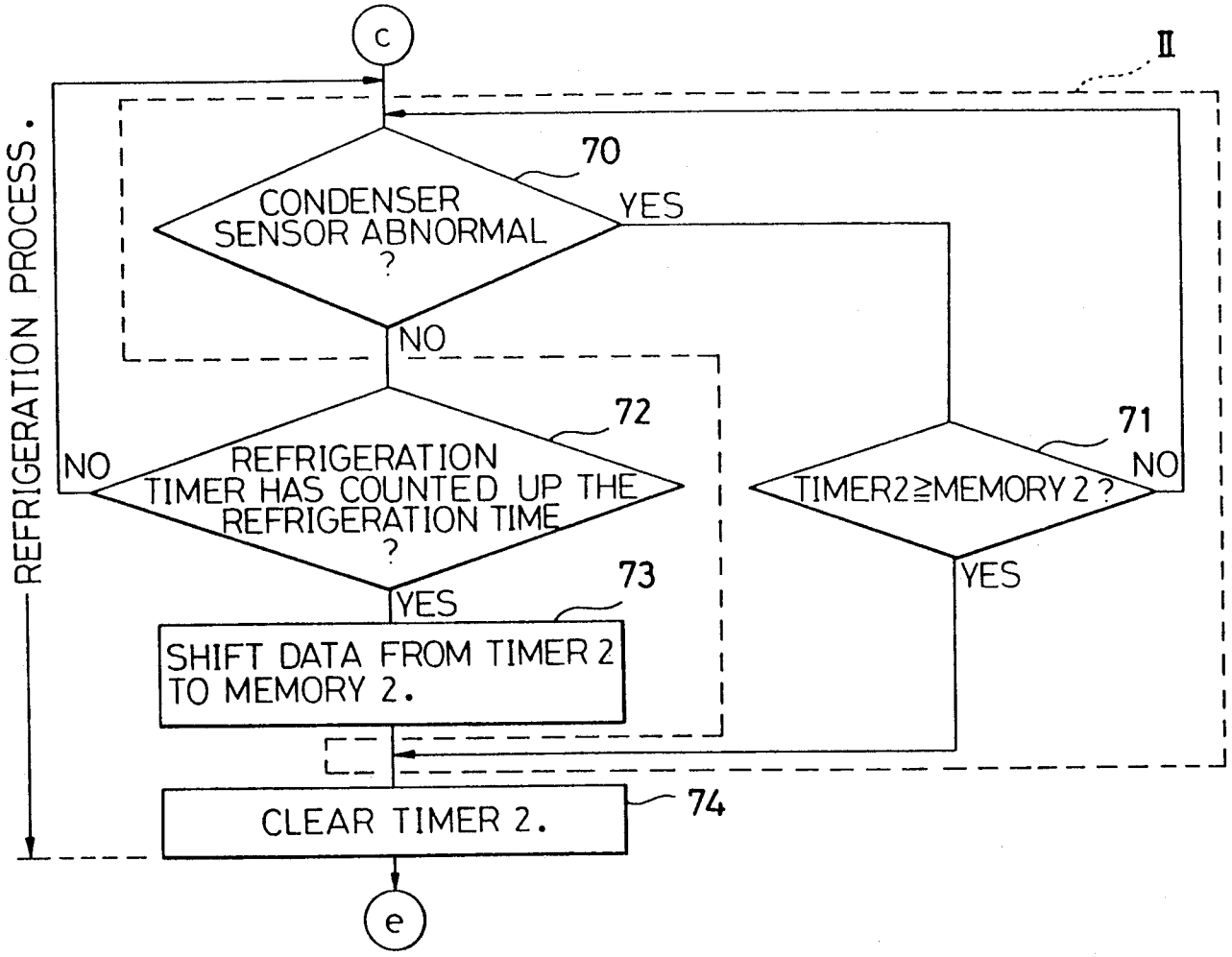
Figure 3C:
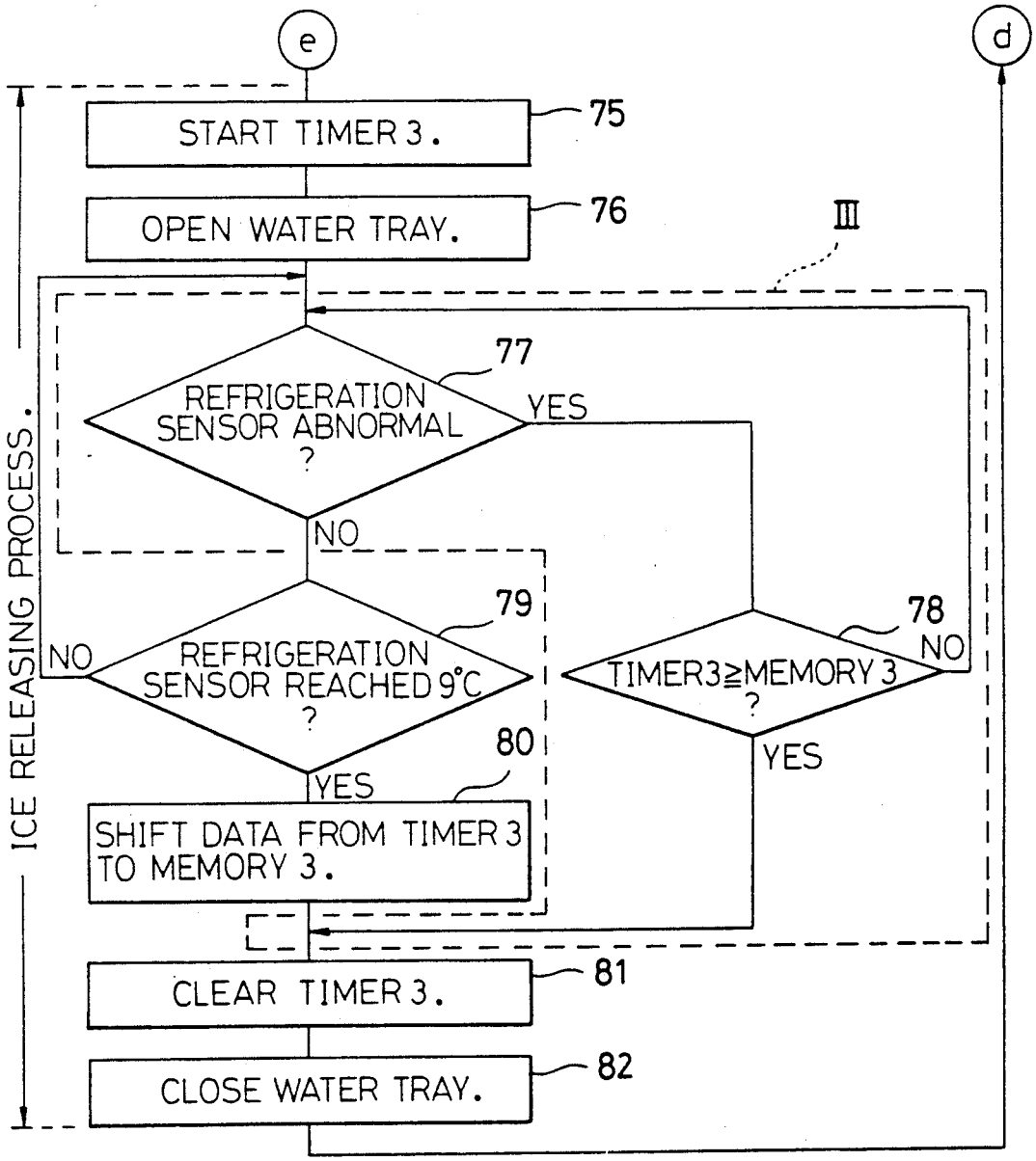

In one aspect the invention utilizes these time data to enable the refrigeration system to continue its operation even under malfunction of the refrigeration sensor and condensation sensor, as discussed below with reference to a flow chart shown in FIG. 3.

If, prior to a water supply process (STEP 61), sensor malfunction has occurred, the operation proceeds to a group of STEPS I marked by a dotted line I subsequent to the start of a timer 1 (STEP 62). Similarly, if sensor malfunction occurred during a preliminary refrigeration process, the operation proceeds to the same group of STEPS I: In STEP 63 a judgement is made if a sensor malfunction has occurred, and if it has (YES in STEP 63), the time counted so far by the timer 1 is compared (STEP 64) with the time data stored in the memory 1 which is representative of the preceding preliminary refrigeration time under normal condition of the sensor. If the counted time data in the memory 1 (YES in STEP 64), the operation proceeds to STEP 67 to clear the timer 1 when the count of the timer 1 reaches the preliminary refrigeration time data. In this manner, irrespective of such sensor malfunction, normal preliminary refrigeration is automatically carried out based on the previous preliminary refrigeration time data. If instead a negative judgement (NO) is made in STEP 63, a normal operation is carried out (STEPS 65 through 67). Under similar malfunction of the condenser sensor during a freezing process, the operation proceeds to a group of STEPS II subsequent to the start of a timer 2 (STEP 68) and a refrigeration timer (STEP 69): If in STEP 70 a judgment is made that sensor malfunction exists (YES), the time counted so far by the timer 2 is compared with the time data stored in the memory 2 which is representative of the preceding refrigeration time (STEP 71) under normal sensor condition. If the counted time memory time data (YES in STEP 71), the operation proceeds to STEP 74 to clear the timer 2 when the count of the timer 2 reaches the preliminary refrigeration time data. In this manner, irrespective of such sensor malfunction, refrigeration is automatically carried out based on the preceding refrigeration time data, providing substantially the same normal ice as under normal sensor condition. If a negative judgment (NO) is made in STEP 70, normal refrigeration operation is carried out (STEPS 72 and 73).

Sensor malfunction found during an ice releasing process is handled in a similar manner: In a block of STEPS III indicated by a dotted line III a judgement is made whether or not the refrigeration sensor is in an abnormal condition subsequent to the start of a timer 3 (STEP 75) and the opening of the water tray 5 (STEP 76). If it is (YES in STEP 77), the time counted by a timer 3 in STEP 78 is compared with the time data stored in a memory 3. The timer 3 is cleared (STEP 81) and the water tray 5 is closed (STEP 82) when the condition the count of the timer time data in memory 3 is satisfied. If a negative judgement is made (NO in STEP 77), normal ice releasing operation is carried out (STEPS 79 and 80).

With the above scheme of operations, ice making cycles may be carried out even under abnormal sensor conditions, yielding the same ice as under normal sensor conditions. Such malfunction as discussed above may be indicated on 7 segment LED indicators 92 (FIG. 4), so that abnormal sensors may be promptly fixed.

The above procedures deal with cases of sensor malfunction encountered during ice making cycles. However, sensors may happen to be in abnormal conditions before the start of the operation. In such a case no time data is stored in memory 1, 2 or 3 based on a preceding ice making cycle, since no ice making cycle was done.

It is necessary, therefore, to provide means for carrying out the STEPS I, II, and III if the sensor abnormality exists from the start, which is another object of the invention. In order to carry out this object, the invention provides, at the time of start up of the apparatus, means for storing (STEP 60) an empirically obtained reference data including a refrigeration time data and an ice releasing data necessary for manufacturing normal ice blocks. In this example, 10 minutes of preliminary refrigeration time, 15 minutes of refrigeration time, and 150 seconds of ice releasing time are initially input in the memory 1, 2, and 3, respectively, in STEP 60 at the time of the start up. In this manner, even when the refrigeration temperature and/or condensation temperature are/is not detected from the beginning on account of sensor malfunction, normal ice making cycles may be carried out based on the above time data. It would be apparent that, if no sensor malfunction exists in the first ice making cycle, these time data are updated through the operations that follow.

Figure 4:
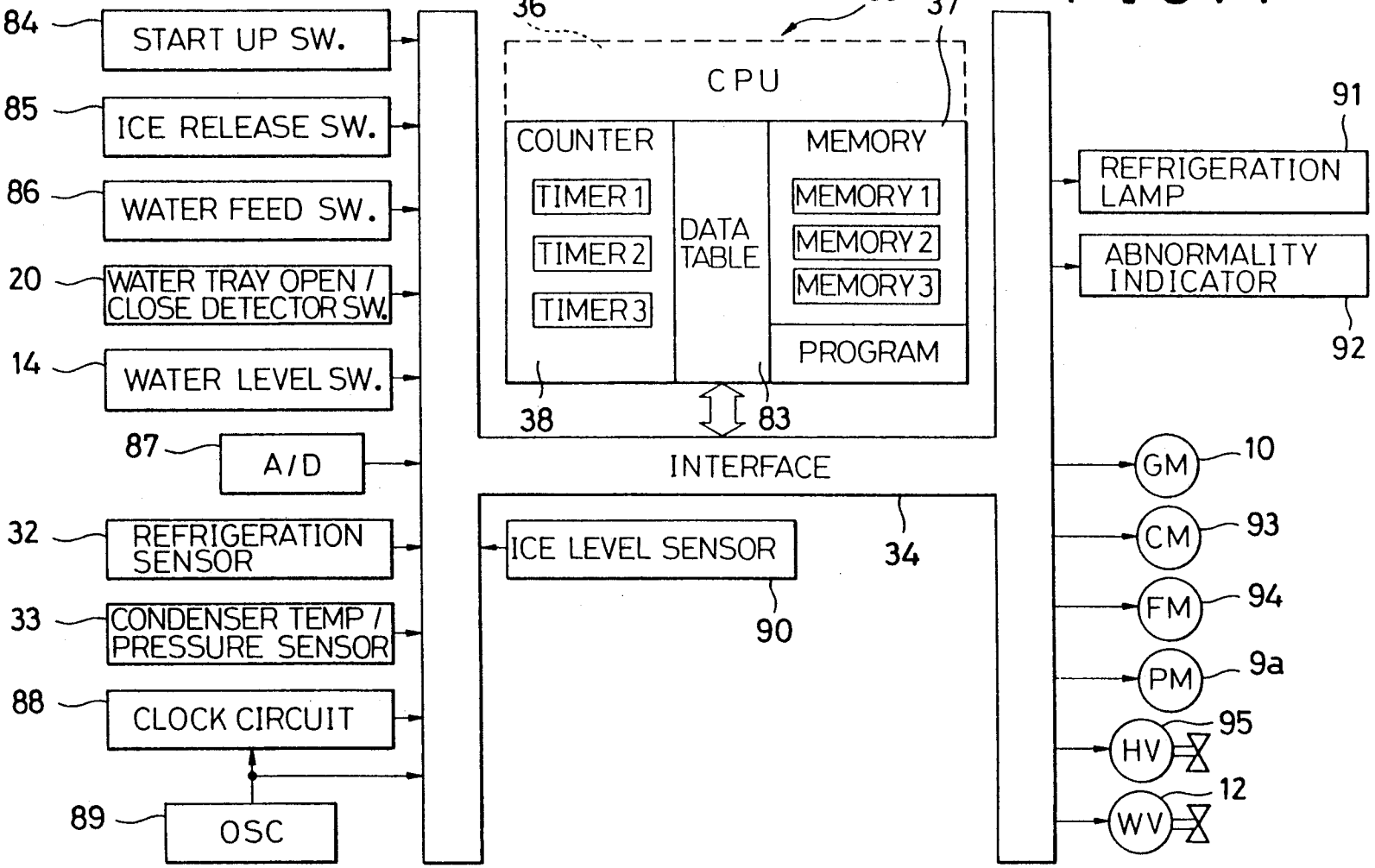
FIG. 4 is a block diagram of the control system according to the invention.

Means for carrying out the above mentioned initialization procedure (STEP 60) is shown in block diagram of FIG. 4. As seen in this figure, the control system includes a microcomputer 35, a CPU 36, a memory 37, a counter 38, a program 39, and a data table 83. The microcomputer 35 receives various information from external equipments through an interface 34, and processes the information to instruct the various equipments to do jobs. The most relevant external equipments are a refrigeration sensor 32 and a condenser sensor 33. The refrigeration sensor 32 detects the temperature of the refrigeration means, while the condenser sensor 33 detects the condensation temperature and/or condensation pressure of the refrigerant. The microcomputer 35 controls the refrigeration process as well as the ice releasing process in response to the outputs of the sensors. A counter 38 includes timers 1, 2, and 3 which are the same as the aforementioned timers 1 through 3, respectively. A memory 37 includes memories 1, 2, and 3, which are the same as the aforementioned memories 1 through 3, respectively. A data table 83 contains reference data needed for determining refrigeration time. The memory 37 stores initialization data such as a set of preliminary refrigeration time, refrigeration time and ice releasing time (which are, for example, 10 minutes, 15 minutes, and 150 seconds, respectively). The control system further includes other elements such as a start up switch 84, an ice releasing switch 85, a water supply switch 86, a water tray open/close position detector 20, a water level switch 14, an analogue-digital converter 87, a clock circuit 88 clocked by an oscillator 89 and operates in association with a counter 38 and the timers. An ice level sensor 90 is provided in an ice storage chamber of the ice making apparatus. Other important elements of the control system are a refrigeration lamp 91, an abnormality indicator 92, a water tray drive motor 10, a compressor motor 93, a fan motor 94, a pump motor **9*a*, a hot gas valve 95, and a water supply valve 12**.

We claim:

1. A control system for use with an ice making apparatus of a refrigeration system having a multiplicity of ice making chambers and a refrigeration means for freezing water introduced in the ice making chambers, the refrigeration system repeating an ice making cycle which consists of a refrigeration process for freezing the water and of an ice releasing process for releasing the ice formed in the chambers, the control system comprising:

a condensation sensor for detecting the thermal conditions of a refrigerant through a condenser in the refrigeration system;

a sensor for detecting the temperature of said refrigeration means;

instruction means having means for adjusting the time of said refrigeration process based on the output of said condensation sensor, means for terminating said ice releasing process based on the output of said refrigeration sensor, counters for counting the time required for said refrigeration process and the time required for the ice releasing process for each ice making cycle, memories for storing and updating time data corresponding to the counted times, sensors for detecting abnormality of said condensation sensor and refrigeration sensor, and a control means for enabling said ice making cycles based on the time data obtained in the preceding ice making cycle and stored in said memories even when said sensors malfunction.

2. A control system for use with an ice making apparatus of a refrigeration system having a multiplicity of ice making chambers and a refrigeration means for freezing water introduced in the ice making chambers, the refrigeration system repeating an ice making cycle which consists of a refrigeration process for freezing the water and of an ice releasing process for releasing the ice formed in the chambers, comprising:

a condensation sensor for detecting the thermal conditions of a refrigerant through a condenser in the refrigeration system;

a sensor for detecting the temperature of said refrigeration means;

a instruction means having means for adjusting the time of said refrigeration process based on the output of said condensation sensor and means for terminating said ice releasing process based on the output of said refrigeration sensor, counters for counting the time required for said refrigeration process and the time required for the ice releasing process for each ice making cycle, memories for storing and updating time data corresponding to the counted times, initialization means for inputting in said memories at the start up of said ice making apparatus a set of standard empirical reference time data required for the refrigeration process and ice releasing process in obtaining normal ice, sensors for detecting abnormality of said condensation sensor and refrigeration sensor, and a control means for enabling said ice making apparatus to start and continue said ice making cycles based on the standard reference time data stored in the memories even when said sensors malfunction at the start up of said apparatus.

3. A control system for use with an ice making apparatus as recited in claim 1, wherein said control system further comprises:

initialization means for inputting in said memories at the start up of said ice making apparatus a set of standard reference time data required for the refrigeration process and ice releasing process; and a control means for enabling said ice making apparatus to start and continue said ice making cycles based on the standard reference time data stored in the memories even when said sensors malfunction at the start up of said apparatus.

* * * * *